United States Patent [19]

Held

[11] Patent Number: 4,948,701

[45] Date of Patent: Aug. 14, 1990

[54] SILVER HALIDE WASH-OUT ELEMENTS

[75] Inventor: Robert P. Held, Englishtown, N.J.

[73] Assignee: E. I. DuPont de Nemours and Company, Wilmington, Del.

[21] Appl. No.: 430,137

[22] Filed: Nov. 1, 1989

[51] Int. Cl.[5] ..... G03C 1/04; G03C 5/36

[52] U.S. Cl. ..... 430/264; 430/266; 430/627; 430/631; 430/635; 430/637

[58] Field of Search ..... 430/264, 266, 627, 631, 430/635, 637

[56] References Cited

U.S. PATENT DOCUMENTS

| | | | |
|---|---|---|---|
| 3,142,568 | 7/1964 | Nottorf | 96/87 |
| 4,076,531 | 2/1978 | Crowell | 96/35 |
| 4,221,858 | 9/1980 | Shiba et al. | 430/266 |
| 4,233,392 | 11/1980 | Friedel | 430/264 |
| 4,309,331 | 1/1982 | Graham | 430/30.6 R |
| 4,456,676 | 6/1984 | Ciskowski | 430/264 |
| 4,588,673 | 5/1986 | Kataoka et al. | 430/264 |
| 4,735,887 | 4/1988 | Foss et al. | 430/264 |

OTHER PUBLICATIONS

U.S. patent application Ser. No. 7/188,558, 3/79, Friedel.

*Primary Examiner*—Paul R. Michl
*Assistant Examiner*—Janis L. Dote

[57] ABSTRACT

A gelatino, silver halide, wash-out element containing a dispersion of a plasticized hydrophobic thermoplastic polymer dispersed as droplets in water, is described. This element can be used to prepare wash-out images of superior quality and integrity. Carbon black also may be present to enhance and darken the resulting images prepared therefrom.

16 Claims, No Drawings

SILVER HALIDE WASH-OUT ELEMENTS

BACKGROUND OF THE INVENTION

1. Field of the Invention

This invention relates to silver halide, wash-out elements and more particularly to wash-out elements in which the imaged areas are hardened by a tanning development step. Still more particularly, this invention provides an improved silver halide, wash-out element wherein the distinction between the imaged and non-imaged areas is improved by the inclusion of polymer droplets in the wash-out element.

2. Background of the Invention

Photographic, gelatino-silver halide elements useful in wash-out systems are well-known in the art. These elements conventionally contain a gelatino-silver halide emulsion layer and optionally contain carbon black to generate high density images. A separate, high tinctorial layer with a colorant such as a pigment or carbon black, for example, also may be employed.

Wash-out elements are used by exposing the element to the desired pattern of actinic radiation to create a latent image in the element. This is typically accomplished by exposure through a mask or by modulating the source of radiation. The latent image is then developed using a tanning developer solution that hardens exposed regions of the emulsion layer without hardening the non-exposed regions. The unhardened gelatin is then washed out with an aqueous solution to leave the desired image.

Carbon black frequently is incorporated in the emulsion layer to permit reduction in the amount of silver employed, thereby reducing cost of the wash-out element, as disclosed in U.S. Pat. No. 4,233,392 to Friedel. Other recent improvements to wash-out elements include the incorporation of amine compounds and complexes to stabilize the elements against premature hardening, as disclosed in U.S. Pat. No. 4,456,676 to Ciskowski.

Despite the many improvements in wash-out elements made over the years, image integrity is still subject to deterioration during the wash-out step. It is desired that the final image have sharp edges. However, the wash-out step tends to be less selective at the boundary of imaged and non-imaged regions of the emulsion, which may cause a blurring of the image. This tendency has more severe results when the wash-out solution is sprayed onto the element at high velocity, as in higher-speed commercial developers, where the spray may undercut the imaged regions if it impacts the element at an angle. Thus, there is a need for further improvements to such wash-out elements.

SUMMARY OF THE INVENTION

It now has been found that image quality (e.g., edge sharpness) of a silver-halide wash-out element is improved by including an aqueous dispersion of a plasticized hydrophobic thermoplastic polymer in the gelatino-silver halide emulsion layer. Preferred polymers are acrylate and/or methacrylate homopolymers and copolymers that are commonly used as binders for photopolymer compositions. The improved silver halide wash-out elements of the invention are conveniently prepared by:

(a) preparing an aqueous solution of gelatin at a temperature above approximately 35° C.;

(b) preparing a solution of plasticizer and hydrophobic thermoplastic polymer in an organic solvent;

(c) blending the solution of step (b) into the solution of step (a), while evaporating said organic solvent, to form an oil-in-water dispersion of plasticized polymer particles in the gelatin solution;

(d) blending the dispersion of step (c) into a gelatin-silver halide emulsion; and (e) coating the composition of step (d) onto a support.

DETAILED DESCRIPTION OF THE INVENTION

The improved silver halide wash-out elements of this invention have particles of a plasticized hydrophobic thermoplastic polymer dispersed in a conventional gelatino-silver halide emulsion layer. Presence of the polymer particles serves to improve image integrity (i.e., edge sharpness) during the wash-out step conducted after exposure of the element to actinic radiation. The amount of dispersed particles will generally be limited to approximately 15% by weight, or less, since higher levels tend to unduly harden non-exposed regions of the element, making it difficult to wash-out these regions while preserving image integrity.

Hydrophobic thermoplastic polymers in general can be selected in practicing the invention, provided the polymer is compatible with the gelatino-silver halide emulsion. Representative polymers that may be selected include: poly acrylates and methacrylates, polyester (e.g., polyarylates), polyimides, vinylidene chloride polymers and copolymers, and vinyl homo and copolymers. Acrylate and/or methacrylate homopolymers and copolymers used as binders in photopolymer compositions can be selected to particular advantage. Polymethacrylate and terpolymers combining acrylates, acrylic acid, and methacrylates are particularly preferred and are commercially available under such tradenames as Elvacite® (E. I. du Pont de Nemours and Company, Wilmington, DE, USA) and Carboset® (B. F. Goodrich Co., Cleveland, OH, USA).

It is highly desirable that the polymer be used in plasticized form in practicing the invention since non-plasticized polymers tend to precipitate during fabrication of the wash-out element. To be useful, it is essential that the polymer particles be uniformly dispersed in the gelatino-silver halide emulsion layer. Plasticizers for the hydrophobic thermoplastic polymers are well known in the art. For the preferred polymethacrylate homopolymers and copolymers, useful plasticizers include alkyl and dialkyl phthalates, caprolates, phosphates (e.g. tricresyl phosphate) among others. A particularly preferred plasticizer is Plasthall® 4141, which comprises triethylene glycol dicaproate and triethylene glycol dicaprylate mixed esters and is available from C. P. Hall Co., Chicago, IL. Generally, plasticizer is present in the range of approximately 0.65 to 1.40 gram per gram of polymer, and preferably in the range of approximately 0.8 to 1.2 grams per gram of polymer.

Carbon black may be added to the emulsion in order to enhance the image density and conserve the use of silver. Stabilized carbon black is particularly useful for this purpose, as described in U.S. Pat. No. 4,233,392 to Friedel. Alternatively, the carbon black can be added to a separate layer under the emulsion layer and achieve the same increase in density during wash-out. It is preferred to add the carbon black directly to the photographic, gelatino-silver halide, oil dispersion-containing emulsion layer in order to achieve optimum results.

Carbon black may be added in a range of 35 to 75 grams per gram of emulsion, and preferably in a range of 45 to 65 grams per gram of emulsion. While inclusion of carbon black may be desirable to enhance image density for some applications of the wash-out element, it is not needed for other applications such as printing and transfer functions.

To fabricate the wash-out element, one initially prepares separate aqueous gelatin and polymer solutions. The aqueous gelatin solution is prepared by mixing gelatin and water for a period of time sufficient to swell, and eventually dissolve, the gelatin. A conventional surfactant used with gelatin solutions may be included in the solution. Stirring generally expedites the process. This step is generally accomplished at a temperature above 35° C. where the gelatin is relatively soluble. The resulting solution will typically contain approximately 4.5 to 6.5 grams of gelatin per 100 grams of water.

The polymer solution is prepared by dissolving the plasticized hydrophobic thermoplastic polymer (i.e., homo- or copolymer) in a suitable solvent. The solvent should have a boiling point high enough that it does not flash during this step, but low enough that the solvent is readily evaporated during the subsequent stage wherein the polymer solution and aqueous gelatin solution are blended to form a dispersion. Suitable solvents for the preferred plasticized polymethyl-methacrylate polymers are trichloroethylene, Perclene®, and other halogenated hydrocarbons, with methylene chloride being preferred.

Heat may be applied to facilitate mixing and dissolution of the polymer in the solvent, provided that care is taken to avoid heating to the point that substantial solvent evaporates during the process. With methylene chloride, for example, the temperature should be kept below room temperature. The resulting solution generally will contain approximately 1.5 to 4.5 grams of polymer per 100 grams solvent.

The polymer solution is then added or blended into the aqueous gelatin solution, with vigorous mixing and heating to enhance evaporation of the polymer solvent, to form a uniform dispersion of the plasticized polymer in the aqueous gelatin solution. This step is generally accomplished above 40° C., typically in the range of 42 to 55° C., depending on the particularly organic solvent that has been selected. Conventional laboratory blending devices such as an Osterizer Blender (Imperial Model, John Oster Mfg. Co., Milwaukee, WI) or similar apparatus which produces high speed mixing of phases, may be used for this purpose. On a larger scale, a device such as Kady Mill (Kinetic Dispersion Corp., Scarborough, ME) or Homogenizer (APV Gaulin Corp., Everett, MA) can be used for mixing these ingredients within the desired temperature ranges. The resulting product is a uniform dispersion of oil-like plasticized polymer in the aqueous gelatin matrix. It is critical that this step take place before silver-halide is added because the high shear forces employed to create the dispersion would adversely affect silver halide sensitivity.

After the plasticized polymer droplets are fully dispersed in the aqueous gelatin phase, the dispersion is added to a conventional photographic, gelatino-silver halide, wash-out emulsion. The emulsion may be a positive or negative working system, and can utilize any of the conventional silver halides (e.g., silver bromide, silver chloride, silver iodide, and mixtures thereof) commonly used in wash-out elements. Optionally, the emulsion may contain a pigment such as carbon black to increase optical density of the element. The emulsion also may contain adjuvents commonly employed in silver halide photosensitive compositions, such as sensitizers, dyes, antifoggants and wetting and coating aids. The dispersion of plasticized polymer is generally added to the photosensitive, gelatino-silver halide emulsion in the range of approximately 0.15 to 0.4 grams of dispersion to per gram of emulsion, and preferably in the range of 0.25 to 0.35 grams per gram of emulsion.

The resulting emulsion, containing dispersed droplets of plasticized polymer, is then coated onto a conventional support. Useful supports include paper or cardboard; films such as cellulose acetate, cellulose triacetate, or a polyester; and flexible, thin metal sheets. Dimensionally stable, heat-set polyethylene terephthalate films may be selected to advantage, in which case the film will generally be subbed with resin and overcoated with a thin, hardened gelatin substratum to enhance adherence of the emulsion. After the emulsion has been coated on the support, an overcoat such as that described in Friedel, U.S. Pat. No. 4,233,392 may be applied to protect the photosensitive emulsion. The element is then dried.

The improved wash-out element may be imaged and developed in conventional fashion, using the processes described in U.S. Pat. No. 4,456,676 to Ciskowski for example. Improvement in image integrity of the elements of this invention can be observed by a microscopic examination of dot edges produced therein. Sharp edges, as those that are provided by the elements of this invention, in comparison to controls (e.g. containing prior art emulsions, for example) are clearly evident at a magnification of 256X. This improved dot edge and quality is noted for 10%, 50% and 90% dots, which represent the entire spectrum of measured dots. The dots produced by the elements of this invention have a more uniform density both inside and outside the immediate dot area. These dots are also clearer and have less image spread than those produced by the prior art.

The present invention has industrial applicability in the field of reproduction, printing and image transfer. Silver halide, wash-out films are used in large numbers by the newspaper industry, for example, as well as in other areas that require low cost elements.

The invention will now be further described in the following examples which illustrate, but do not limit, the invention.

EXAMPLE 1

Carbon black chips were prepared by taking 45% by weight of carbon black (Sterling HS, Cabot Corp., Springfield, MA.) and 55% by weight of an acrylic terpolymer of methyl-methacrylate/ethyl acrylate/acrylic acid, Carboset® 525 (B. F. Goodrich Co.), Acid No. 76–85, and M. W. of ca. 260,000 and two-roll milling these ingredients at 80–100° C. The sheet of this material was then broken into the desired chips.

An aqueous phase was then prepared by combining 75 g of distilled water, 4.5 g gelatin, 1.9 g of a 40% solution of polyvinylpyrrolidone, 0.4 g of a surfactant (Triton® QS44, Rohm & Haas Co., Philadelphia, PA) and 1.0 g of a 10% Saponin surfactant solution.

An organic phase was prepared by dissolving 5.0 g of the carbon chips made above and 3.2 g. of Plasthall® 4141 plasticizer in 30 g of methylene chloride and 3 g of methanol. The aqueous phase, which had been held at a temperature above 35° C., was placed in a conventional Osterizer Blender and the organic phase then poured into the aqueous phase while mixing. With continued mixing in the blender, the organic solvent evaporated leaving oil droplets of the plasticized terpolymer dispersed in the aqueous gelatin phase. After the solvent evaporation was complete, the resulting dispersion was added to a photographic, gelatino-silver halide emulsion.

The photographic, gelatino-silver halide emulsion was an all bromide, graphic arts-type emulsion used as the photosensitive material for this invention. This emulsion, which weight 90 g, contained 5.2 g gelatin, 270 g distilled water, 5 g Acrysol ® WS50 latex (Rohm & Haas), 13 g of a mixture which comprised 8% of polyethylene oxide (M. W. ca. 1,000) acetylaminophenol (4AAP in a mixture of 95% ethanol and 5% methanol.

After fully mixing the organic dispersion and the silver halide emulsion, this mixture was coated on a conventional, 4.0 mil dimensionally stable, polyethylene terephthalate film support which had first been coated with a gelatin sublayer. The coating weight was ca. 18 mg/dm$^2$ express as AgBr. This layer was then overcoated with a polyvinyl alcohol layer containing the spiro-bisindane tanning developer from the aforementioned Friedel reference. For control purposes, a coating was prepared by coating and overcoating the same photographic, gelatino-silver halide emulsion containing an equivalent amount of stabilized carbon black as described in the Friedel reference but without the dispersed, plasticized terpolymer of this invention. Samples of both the control and the invention were then exposed using 10%, 50% and 90% halftone dot screens to a mercury light source at a distance of 58 inches. The exposure was 38 seconds. After exposure, the images were produced by washing-out the unexposed portions with a 16% sodium carbonate solution and fixing with conventional sodium thiosulfate. The images were then washed thoroughly with water. All of these procedures are fully described in the aforementioned Friedel and Ciscowski references. On detailed examination of the images produced in both the sample of this invention and the control, it was found that the dots produced in those of the invention were sharper and more discrete than those of the controls. They were also more durable and not as easily scratched and more resistant to wear or scratching. This was a surprising finding since it was not thought that improved toughness would be found in addition to higher image quality.

EXAMPLE 2

An organic phase comprising 3.0 g of a polymethylmethacrylate homopoymer (Elavcite ® 2051, E. I du Pont de Nemours & Co., Wilmington, DE.), 3.2 of a plasticizer (Plasthall ® 4141) and 20 g of methylene chloride was prepared. An aqueous phase comprising 75 g distilled water, 4.5 g gelatin, 1.9 g of a 40% of an aqueous solution of polyvinyl pyrrolidone, 0.4 g of Triton ® QS44 surfactant and 1.0 g of a 10% aqueous Saponin solution were also mixed. The aqueous phase was heated to 40° C. and placed in an Osterizer Blender. The organic phase was added to the warm aqueous phase over a 5 minute period. On completion of the addition of organic to aqueous, and after the organic solvent had evaporated, a satisfactory oil dispersion of the organic phase in the aqueous phase was observed.

A silver bromide photographic emulsion was made as follows:

| Ingredient | Amount (g) |
|---|---|
| AgBr Emulsion | 90 |
| Distilled Water | 165 |
| Gelatin | 5.2 |
| Latex (Acrysol ® WS50) | 5 |
| PEO/BS Mixture | 13 |
| Acetylamino phenol (14% in ethanol/methanol mixture 95/5) | 8.4 ml |
| Carbon Black (Helioschwartz mixed into 50 g water) | 55 |
| VM Paste, 37–38%, Bayer AG Lever Kusen (Germany) | |
| 5% FC-128 Flurocarbon Surfactant in water (3M Co.) Minneapolis, MN | 10 |
| Mixture of: Aerosol OT75 - 12.5 g, Aerosol TR70 - 12.5 g, and 225 g distilled water (Aerosol OT75 & TR70 American Cyanamid Co.) | 5 |

The above emulsion and the oil dispersion in water were then combined and coated on a dimensionally stable polyethylene terephthalate film support that had been resin subbed on both sides. Additionally, the side on which the coating of this invention was placed, contained a thin, hardened substratum of gelatin coated over the resin sub. A control emulsion containing all the ingredients except for the oil dispersion in water was also prepared. Both of these coatings were overcoated as described in Example 1. Samples from both coatings were then exposed and processed as described in Example 1. Tests made on these processed samples showed that the coating of this invention had superior image integrity over that of the control. To demonstrate the importance of the plasticizer, another organic phase was made similar to that described above but adding only half the amount of plasticizer (Plasthall ® 4141). When this organic phase was combined with the same aqueous phase as described above, the oil in water dispersion was not satisfactory.

EXAMPLE 3

An organic phase was prepared by combining 5.0 g of the carbon black chips prepared in Example 1, 3.2 g of the plasticizer Plasthall ® 4141, 50 g of methylene chloride, 15 g of methanol and 20 ml of acetone. An aqueous phase was then prepared by combining 75 g of distilled water, 4.5 g gelatin, 1.9 g of 40% aqueous polyvinyl pyrrolidone, 0.4 of Triton ® QS 44 and 1.0 g of 10% aqueous Saponin as the surfactants. An oil in water dispersion was produced by blending the organic phase into the aqueous phase that had been warmed sufficiently to evaporate the organic solvents slowly. This step was carried out in a blender in a hood.

The photographic, gelatino silver bromide emulsion was prepared as described in Example 1 except that carbon black was not added. A portion of this emulsion was coated on a polyethylene terephthalate film support as previously described and overcoated. This served as the control. Another portion of the photographic, gelatino, silver bromide emulsion was combined with the oil in water dispersion and this was then coated in a like manner on a film support, followed by an overcoat as described in Example 1. The coatings were dried, exposed, developed and washed as previously described.

Even though there was no pigment in the element, the coating having the oil in water dispersion of this invention showed an improvement in dot quality. The dots from the film of this invention had better integrity than that of the control.

EXAMPLE 4

An organic phase was prepared by combining 20 g of a carbon black chip material which comprises 50% Monarch 1300 Carbon Black (Cabot Corp., Boston, MA). 7.5 % Elveron ® 6307 (E. I. du Pont de Nemours & Co., Wilmington, DE), 42.5% of a methylmethacrylate/n-butylmethacrylate/ methacrylic acid terpolymer (Elvacite ® 2013, E. I. du Pont de Nemours & Co., Wilmington, DE.) 5 g of the aforementioned Plasthall ® 4141 and 50 g of methylene chloride. An aqueous phase was prepared by combining 75 g distilled water, 4.5 g gelatin, 1.9 g of a 40% aqueous polyvinylpyrrolidone solution, and 0.4 g Triton ® QS44 and 1.0 g 10% aqueous Saponin solution as the surfactants. Blending of the two phases and evaporation of the organic solvent to form an oil in water dispersion was accomplished as described in Example 3. As described in that example, the oil in water dispersion was added to a similar photographic, gelatino, silver bromide emulsion but without carbon black. The emulsion was coated, overcoated, dried, exposed, developed and washed as previously described. No wash-out of the image areas occurred since too much of the oil emulsion containing polymer was present. This example indicates the upper limit of the oil/polymer range. Thus, based on the total amount of silver halide plus gelatin present, there can be no more than approximately 15% by weight of polymer in the dispersion.

EXAMPLE 5

A latex polymer made according to the teachings of Nottorf, U.S. Pat. No. 3,142,568, was used in place of the polymers described in this invention and exemplified above. This procedure was as described in the Nottorf reference, Cols. 3 and 4, Procedures A, B and C. This material did not make a satisfactory oil in water dispersion and film elements coated therefrom did not have satisfactory dot quality or integrity. The latex polymer used in this example is a hydrophilic polymer, demonstrating that hydrophobic polymers should be selected in practicing the invention.

Having described the invention, I claim the following and equivalents thereof:

1. In a silver halide wash-out element comprising a support that bears at least one gelatino-silver halide emulsion layer, the improvement wherein edge sharpness of the developed image is improved by including in the gelatino-silver halide emulsion layer an aqueous dispersion of a plasticized hydrophobic thermoplastic polymer.

2. The element of claim 1 wherein said dispersion is present in said emulsion in an amount up to approximately 15% by weight of the emulsion.

3. The element of claim 2 wherein said thermoplastic polymer is an acrylate or methacrylate homopolymer or copolymer.

4. The element of claim 3 wherein the plasticizer is triethylene glycol dicaproate and triethylene glycol dicaprylate mixed esters.

5. The element of claim 1 or 3 wherein carbon black is also present in the gelatino-silver halide emulsion layer.

6. The element of claim 5 wherein carbon black is present in the range of approximately 35 to 75 grams per gram of emulsion.

7. The element of claim 1 or 3 wherein carbon black is present in a separate layer between the gelatino-silver halide emulsion layer and the support.

8. The element of claim 1 or 3 wherein plasticizer is present in the range of approximately 0.65 to 1.40 grams per gram of polymer.

9. A process for preparing a high quality, wash-out, photographic gelatino-silver halide element with improved image integrity comprising the steps of:

(a) preparing an aqueous solution of gelatin and surfactant at a temperature above approximately 35° C.;

(b) preparing a solution of plasticizer and hydrophobic thermoplastic polymer in an organic solvent;

(c) blending the solution of step (b) into the solution of step (a), while evaporating said organic solvent, to form an oil-in-water dispersion of plasticized polymer particles in the gelatin solution;

(d) blending the dispersion of step (c) into a gelatino-silver halide emulsion; and (e) coating the composition of step (d) onto a support.

10. The process of claim 9 wherein the quantities of gelatin and water selected in step (a) form a solution containing approximately 4.5 to 6.5 grams of gelatin per 100 grams of water.

11. The process of claim 9 wherein the quantities of hydrophobic thermoplastic polymer and organic solvent selected in step (b) form a solution containing approximately 1.5 to 4.5 grams of polymer per 100 grams solvent.

12. The process of claim 11 wherein step (b) is conducted below approximately 35° C.

13. The process of claim 9 wherein the blending step (c) is conducted at a temperature higher than approximately 40° C.

14. The process of claim 13 wherein the temperature is within the range of approximately 42 to 55° C.

15. The process of claim 9 wherein the quantities of dispersion and gelatino-silver halide emulsion selected in step (d) form an emulsion containing approximately 0.15 to 0.4 grams of dispersed plasticized thermoplastic polymer per gram of emulsion.

16. The process of claim 9 wherein the emulsion contains approximately 0.25 to 0.35 grams of dispersed plasticized acrylate or methacrylate homopolymer or copolymer per gram of emulsion.

* * * * *